US008109098B2

(12) United States Patent
Parker

(10) Patent No.: US 8,109,098 B2
(45) Date of Patent: Feb. 7, 2012

(54) COMBUSTOR LINER FOR GAS TURBINE ENGINE

(75) Inventor: David M. Parker, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 993 days.

(21) Appl. No.: 11/418,064

(22) Filed: May 4, 2006

(65) Prior Publication Data

US 2007/0256417 A1 Nov. 8, 2007

(51) Int. Cl.
*F02C 1/00* (2006.01)

(52) U.S. Cl. ..... 60/752; 60/39.37

(58) Field of Classification Search ..... 60/752–760, 60/748, 39.37, 796–800, 806
See application file for complete search history.

(56) References Cited

U.S. PATENT DOCUMENTS 3,657,883 A * 4/1972 De Corso ..... 60/39.37
4,244,178 A 1/1981 Herman et al.
4,719,748 A 1/1988 Davis, Jr. et al.
4,903,477 A 2/1990 Butt
5,291,732 A * 3/1994 Halila ..... 60/796
5,528,904 A * 6/1996 Jones et al. ..... 60/753
6,282,905 B1 9/2001 Sato et al.
6,837,051 B2 1/2005 Mandai et al.
6,923,002 B2 * 8/2005 Crawley et al. ..... 60/772
7,340,900 B2 * 3/2008 Xu et al. ..... 60/737
2002/0184889 A1 * 12/2002 Calvez et al. ..... 60/796
2003/0000217 A1 * 1/2003 North et al. ..... 60/772
2003/0061815 A1 * 4/2003 Young et al. ..... 60/748
2004/0261419 A1 * 12/2004 McCaffrey et al. ..... 60/796
2006/0174625 A1 * 8/2006 Ohri ..... 60/737
2006/0242939 A1 * 11/2006 Pieussergues et al. ..... 60/39.35

* cited by examiner

*Primary Examiner* — Ehud Gartenberg
*Assistant Examiner* — Phutthiwat Wongwian

(57) ABSTRACT

A combustor liner (230) for a gas turbine engine combustor (200) comprises an inner wall (232), an outer wall (238), a cooling air flow channel (244) formed there between, and a flow control ring (246). The flow control ring (246) is sealingly attached to the downstream ends of the inner wall (232) and the outer wall (238), and comprises a plurality of holes (250) that, during gas turbine engine operation, may regulate a flow of cooling air that passes through the cooling air flow channel (244). One or more surfaces may be coated with a thermal barrier coating (237) to provide additional protection from thermal damage.

13 Claims, 4 Drawing Sheets

COMBUSTOR LINER FOR GAS TURBINE ENGINE

FIELD OF THE INVENTION

The invention generally relates to a gas turbine engine, and more particularly to the combustor liner of such an engine.

BACKGROUND OF THE INVENTION

In gas turbine engines, air is compressed at an initial stage, then is heated in combustors, and the hot gas so produced drives a turbine that does work, including rotating the air compressor.

A number of existing gas turbine engine designs utilize some of the air from the air compressor to cool specific components that are in need of cooling. In some designs air is passed along a surface to provide convective cooling, and the air then continues to an intake of a combustor, and into the combustor where the oxygen of the air is utilized in the combustion reaction with fuel. This approach generally is referred to as "closed cooling." In other designs, generally referred to as "open cooling," air for cooling is passed into the flow of hot gases downstream of the combustion intake. In the latter cases a percentage of oxygen in such air for cooling may not be utilized in combustion, and this represents a potential inefficiency in that a percentage of the work to rotate the compressor does not supply air to the combustor intake for combustion purposes. The ultimate determination of whether it is more cost-effective to provide open cooling depends on balancing a number of factors, including expected component life cycle, and the costs of alternative cooling.

Combustor liners help define a passage for combusting hot gases immediately downstream of swirler assemblies in a gas turbine engine combustor. The surfaces of combustor liners are subject to direct exposure to the combustion flames in a combustor, and are among the components that need cooling in various gas turbine engine designs. An effusion type of open cooling has been utilized to cool combustor liners. This generally is depicted in FIG. 1A, which provides a cross-sectional of a prior art combustor 100. A predominant air flow (shown by thick arrows) passes along the outside of combustor 100 and into an intake 102 of the combustor 100. Centrally disposed in the combustor 100 is a pilot swirler assembly 104, and disposed circumferentially about the pilot swirler assembly 104 are a plurality of main swirler assemblies 106. Combustion generally takes place somewhat downstream of the pilot swirler assembly 104, designated in FIG. 1A as combustion zone 108. A transversely disposed base plate 110 receives downstream ends of the main swirler assemblies 106, and provides a physical barrier to flames that may otherwise travel upstream. An outlet 111 at the downstream end passes combusting and combusted gases to a transition (not shown, see FIG. 3).

Surrounding the combustion zone 108 is an annular effusion liner 112, and further outboard is a cylindrical frame 114. Welded to the frame 114 at its downstream end is an assembly of spring clips 116, which contacts a transition ring 120 of a transition (not shown in FIG. 1A). A plurality of holes (not shown) in the frame 114 allows passage of a quantity of air (shown by narrow arrows) that may pass through spaced apart effusion holes (not shown in FIG. 1A) in the effusion liner 112. FIG. 1B provides an enlarged view of the encircled section of FIG. 1A, in which spaced apart effusion holes 122 are depicted. The passage of air through the effusion holes 122 provides for a cooling of the effusion liner 112.

Referring to FIG. 1B, passage of air also is designed to occur along a radial gap 125 between the respective downstream ends 113 and 115 of the effusion liner 112 and the frame 114. The gap 125 is required to accommodate axial and radial differential expansion between the effusion liner 112 and the frame 114, and air flowing through the gap 125 also provides a cooling effect for the end of the effusion liner 112 and the frame 114. In certain embodiments a plurality of spaced apart protrusions 116 disposed at or near the end 113 of the effusion liner 112 establish the radial height of the gap 125.

Based on observation and analysis of present systems, such as that described in FIGS. 1A and 1B, and potential problems in some units of such systems, there is a need for an improved combustor liner that overcomes such problems.

BRIEF DESCRIPTION OF THE DRAWINGS

Aspects of the invention are explained in following description in view of drawings that are briefly described below.

DETAILED DESCRIPTION OF THE INVENTION

Figure 1A:
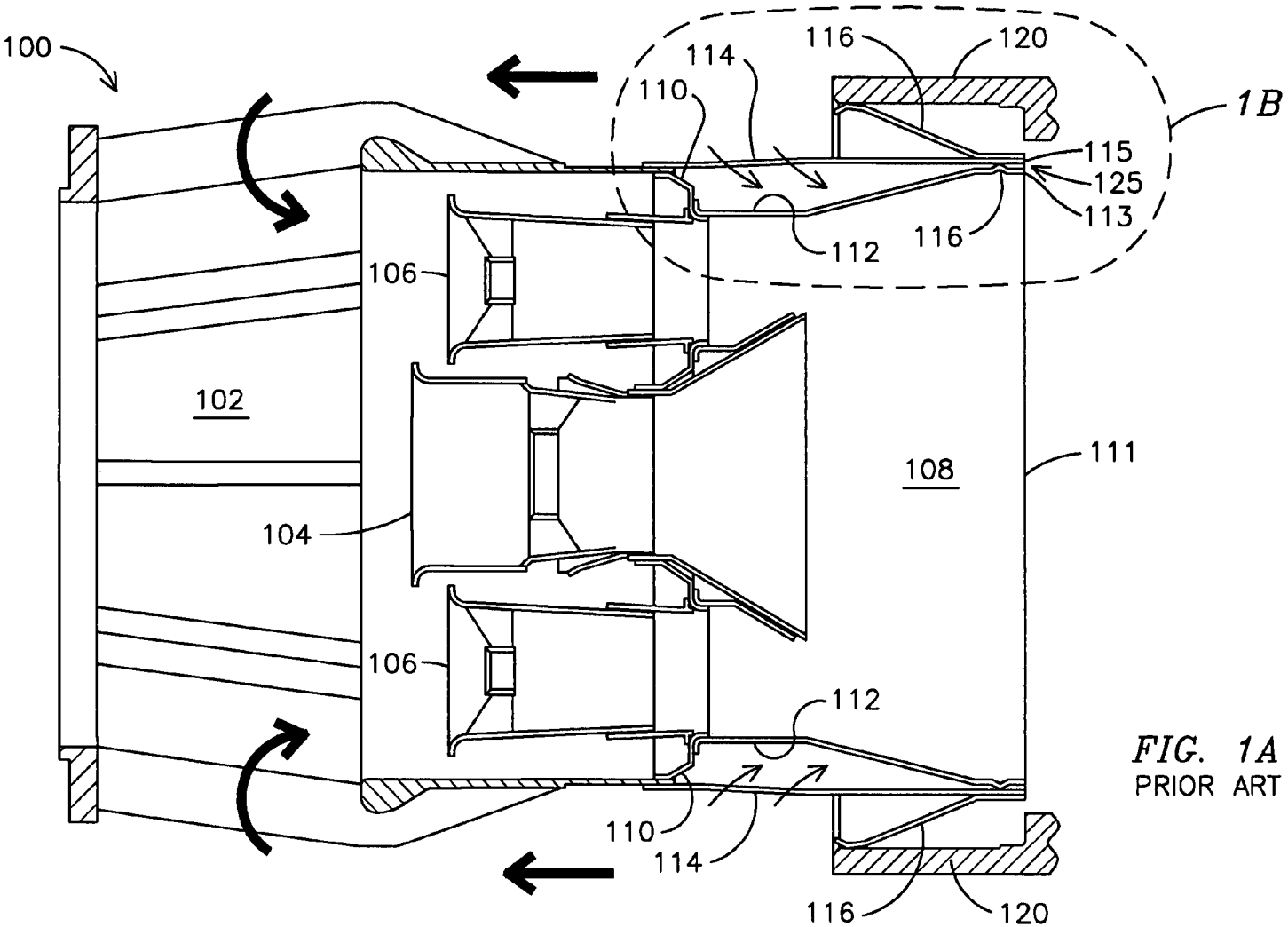
FIG. 1A PRIOR ART
FIG. 1A is a lateral cross-sectional view of a prior art combustor comprising an effusion-type combustor liner.

Embodiments of the present invention provide for uniformly controlled open cooling of a double-walled combustor liner that is effective to predictably and consistently provide cooling air currents to such liners. The present invention was created as a result of first identifying potential problems with presently used liner systems in gas turbine combustors. For example, referring to FIG. 1B, it has been appreciated that the radial gap 125 may at times allow excessive air flow and/or provide an uneven air flow, either of which are hypothesized to have the potential to lead to lower gas turbine engine performance. Factors affecting the size and non-uniformity of the gap 125 may include: 1) in-tolerance 'mismatches' in which respective ends 113 and 115 of the effusion liner 112 and the frame 114 are within their respective tolerances, but at extreme ends of the respective in-tolerance ranges (i.e., end 113 at lower end, end 115 at upper end); 2) thermal expansion; 3) out of round condition of the effusion liner 112 and/or the frame 114; and 4) a permanent set in the effusion liner 112 and/or the frame 114, such as due to creep or plastic deformation caused by thermally induced stresses. It is appreciated that the performance of individual units may vary depending on the effect of one or more of these factors, and this may lead to variability in performance among the different combustors in a particular gas turbine engine (such as a can-annular style). In addition to such potentially adverse performance, such variability is hypothesized make less clear the diagnosis of other issues.

Based on such appreciation of potential air leakage and unequal passage of cooling air with existing combustor liner designs, a new liner is developed. This development is directed to overcome gap variation and consequent performance imbalances hypothesized to affect some combustor units. The new liner comprises an inner annular wall the inside surface of which is directly exposed to the combustion zone, an outer annular wall, spaced from the inner annular wall, a cooling air flow channel formed there between, and a flow control ring to which are attached the downstream ends of the inner and outer annular walls. The flow control ring comprises a plurality of holes through which cooling air from the cooling air flow channel passes. As used with regard to the flow control ring and any other component of the present invention, the term "hole" is not meant to be limited to a round aperture through a body as is illustrated in the embodiment depicted in the figures. Rather, the term "hole" is taken to mean any defined aperture through a body, including but not limited to a slit, a slot, a gap, a groove, and a scoop. The liner structure eliminates the above-described gap between prior art liner and frame ends through which, it is hypothesized, air may flow unevenly and wastefully. In contrast, the present invention comprises a cooling air flow channel in fluid communication with spaced apart holes of the flow control ring which together may provide a desired level of cooling to the inner annular wall, the flow control ring and to components downstream of the flow control ring. Further as to temperature management, in certain embodiments a portion of the inner surface of the inner annular wall comprises a Thermal Barrier Coating ("TBC"), such as a ceramic coating, that provides enhanced thermal protection to this portion. Other aspects of the invention are disclosed during and after discussion of specific embodiments provided in the appended figures.

Figure 2A:
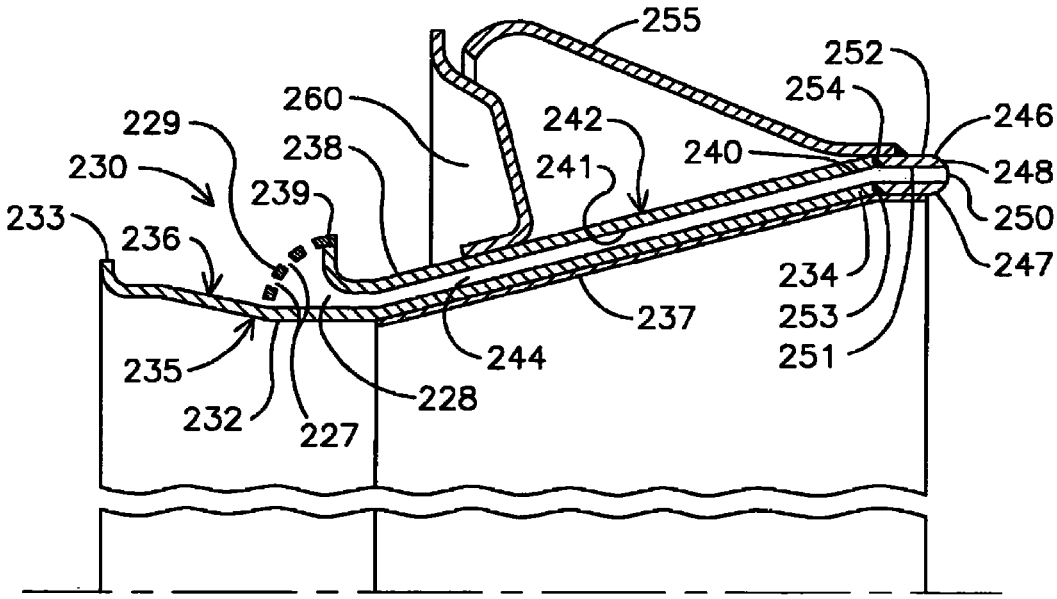
FIG. 2A provides a partial lateral cross-sectional view of one embodiment of a combustor liner of the present invention, with two components attached to the combustor liner.

FIG. 2A depicts an exemplary embodiment of a new liner 230. Liner 230 comprises an inner wall 232, an outer wall 238, a cooling air flow channel 244 formed there between, and a flow control ring 246. The inner wall 232 of liner 230 comprises an upstream end 233, a downstream end 234, welded to the flow control ring 246, an inner surface 235, and an outer surface 236. The outer wall 238 comprises an upstream end 239, a downstream end 240, also welded to flow control ring 246, an inner surface 241, and an outer surface 242. The flow channel 244 is annular and has a length defined from the upstream end 239 to the downstream end 240 of outer wall 238, and a width defined as the distance between the inner wall 232 outer surface 236 and the opposing inner surface 241 of the outer wall 238.

In the depicted embodiment, a major portion, meaning more than 50 percent, of the inner surface is coated with a thermal barrier coating 237. Other embodiments may comprise no thermal barrier coating, a total coverage with a thermal barrier coating, or a smaller percentage coverage with a thermal barrier coating.

The downstream end 234 of inner wall 232 is welded to an inboard region 247 of flow control ring 246, and the downstream end 240 of outer wall 238 is welded to flow control ring 246 along an outboard region 248 of flow control ring 246. Thus, the flow control ring 246 may generally be considered to comprise an inboard region 247 lying inboard of a central region (identified as 249 in FIG. 2C) that comprises a plurality of holes 250, and an outboard region 248 disposed outboard of the central region (identified as 249 in FIG. 2C). In FIG. 2A an inboard surface 251 of the inboard region 247 is shown as coated with thermal barrier coating 237, and on an outboard surface 252 of the outboard region 248 there is an attachment of a spring clip assembly 255. Neither the presence of the thermal barrier coating 237, nor the attachment of the spring clip assembly 255 to flow control ring 246, is meant to be limiting of the scope of the present invention.

An opening 228 allows for air to pass from the compressor (not shown) into the cooling air flow channel 244. A protective barrier 229 covers the opening 228, and may be constructed of screen, mesh, or sheet metal with holes 227 there through, having sufficient open area for passage of a desired amount of cooling air into cooling air flow channel 244. The protective barrier 229 is provided when there is a concern that errant objects flowing with the compressor air flow may become entrapped in the cooling air flow channel 244 or the holes 250 of the flow control ring 246. It is noted that some embodiments do not comprise protective barrier 229. In various embodiments that do comprise a protective barrier such as protective barrier 229 in FIGS. 2A and 2B, the protective barrier may be attached to either the inner or to the outer wall, that is, to at least one of the inner and the outer wall. Attachment to only one of the two walls allows differential movement of the two walls as a function of different thermal expansion of these two walls. Further, as one example of an alternative to the protective barrier 229, the upstream end 239 of outer wall 238 may be bent downward, toward the outer surface 236 of inner wall 232, and may have any types of holes through it, and/or grooves or cuts, etc. at its edge, that are of a desired size, so as to provide a variant of a protective barrier across the upstream end 239 of flow channel 244.

The separation between the inner wall 232 and the outer wall 238 may be established by any spacing means (not shown) as is known to those skilled in the art. Structures generally known "stand-offs" may be provided at spaced intervals to establish a desired space between the inner wall 232 and outer wall 238. One example of a stand-off, not to be limiting, is a rod of a desired length, having a broad head, that is inserted into a first wall so that the non-headed end of the rod contacts the inside surface of the opposing wall. While in such position the broad head is welded to the outside of the first wall. This provides a minimum distance between the walls.

While not meant to be limiting of the scope of the present invention, in the embodiment depicted in FIG. 2A a barrier structure 260 is attached, such as by welding, to the outside surface 242 of outer wall 238. The barrier structure 260 limits movement of broken-off spring clips (not shown in FIG. 2A), and is described in greater detail in U.S. patent application Ser. No. 11/117,051, which is incorporated by reference herein for such teachings. More generally, this and all other patents, patent applications, patent publications, and other publications referenced herein are hereby incorporated by reference in this application in order to more fully describe the state of the art to which the present invention pertains, to provide such teachings as are generally known to those skilled in the art, and to provide specific teachings as may be noted herein.

Figure 2B:
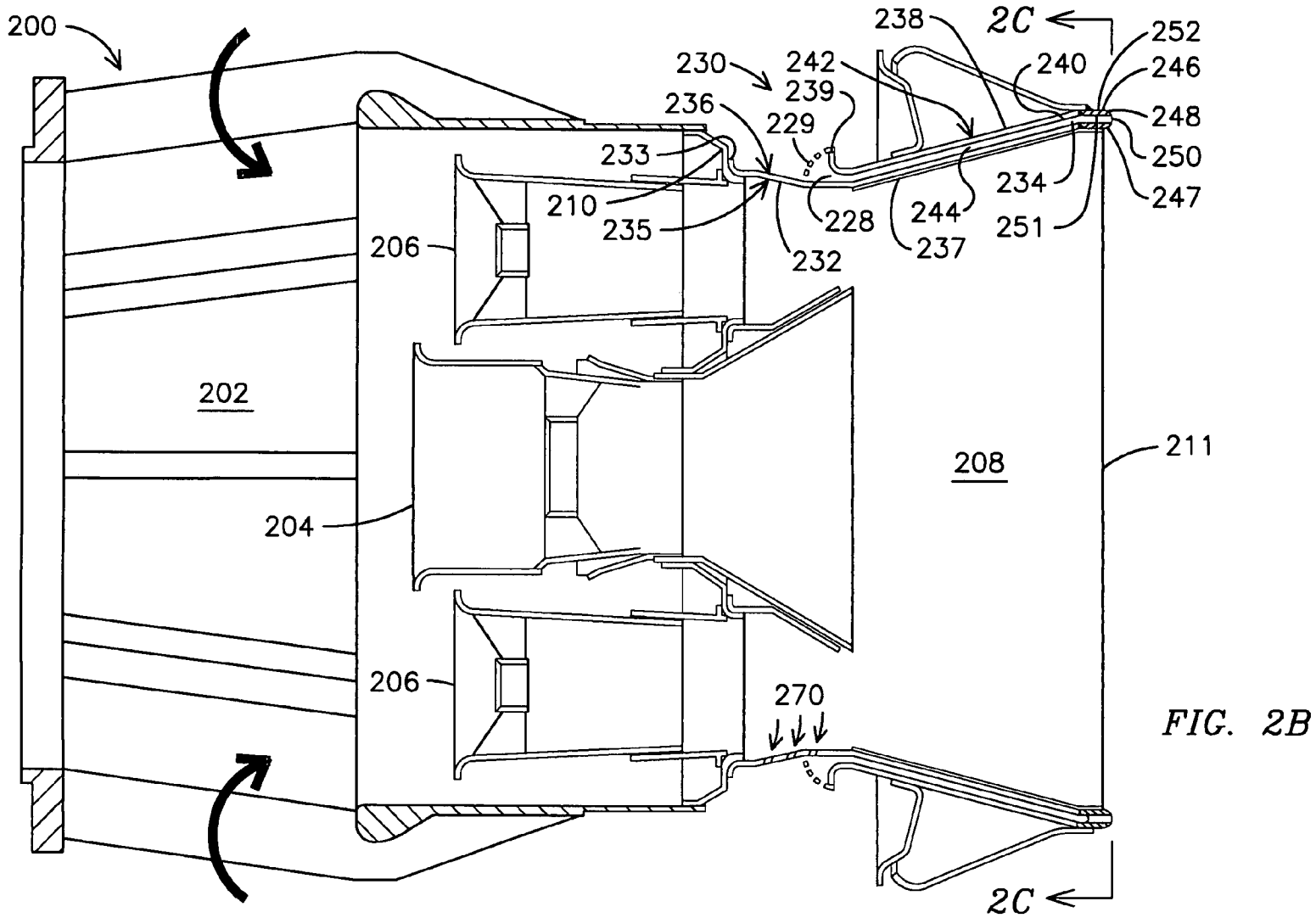
FIG. 2B provides a lateral cross-sectional view of a combustor comprising the combustor liner of FIG. 2A.

FIG. 2B depicts a combustor 200 in cross-section, comprising the liner 230 of FIG. 2A. In addition to the liner 230, combustor 200 comprises standard combustor components that include an intake 202, a centrally disposed pilot fuel swirler assembly 204, a plurality of main swirler assemblies 206, a base plate 210, and an outlet 211. A combustion zone is indicated by 208.

Figure 1B:
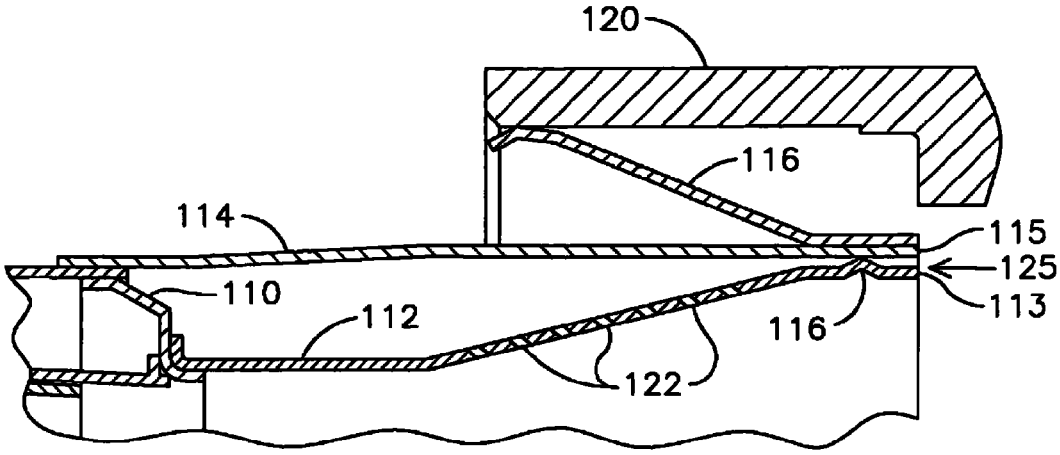
FIG. 1B PRIOR ART
FIG. 1B provides an enlarged view of an encircled portion of the prior art combustor depicted in FIG. 1A.

It is noted that for embodiment depicted in FIGS. 2A and 2B, no component corresponds exactly to the cylindrical frame 114 in FIG. 1A. As an alternative, the liner 230 may be constructed of sufficiently strong material to support the spring clip assembly 255 and forces transmitted through this structure. For example, not meant to be limiting, the thickness of the inner wall 232 may be 0.090 inches, rather than a more commonly used 0.060 inches thickness. As viewable in FIG. 2B, the upstream end 233 of the inner wall 232 is shown welded to a curved section of base plate 210. This provides for structural integrity and transfer of forces between the spring clip assembly 255 and the combustor 200. However, this arrangement is not meant to be limiting.

Further to the thermal barrier coating 237, as depicted in FIGS. 2A and 2B, the thermal barrier coating 237 covers not only a major portion of the inner surface 235 of the inner wall 232, but also covers most of the inboard surface 251 of the flow control ring 246. A thermal barrier coating such as 237 may be comprised of any suitable composition recognized to provide an effective thermal barrier in the operating temperature range of the combustion zone 208. A ceramic coating may be used, for example. This would be applied over the surface of the material of the inner wall 232 after suitable surface preparation. It is noted that the composition of the inner wall 232, the outer wall 238, and the flow control ring 246 may be a nickel-chromium-iron-molybdenum alloy (e.g. HASTELLOY® X alloy), an alloy known to those skilled in the art of gas turbine engine construction. Other metal alloys known to those skilled in the art, or other non-metallic materials, may alternatively be utilized.

Also, although not depicted in FIG. 2A, a thermal barrier coating (such as 237) may be applied not only to the inner surface 235 of the inner wall 232, and to the inboard surface 251 of the inboard region 247 of the flow control ring 246, but also may be applied to cover the outboard surface 252 of the outboard region 248, and the exposed downstream surfaces of the flow control ring 246 that are between the inboard surface 251 and the outboard surface 252.

Figure 2C:
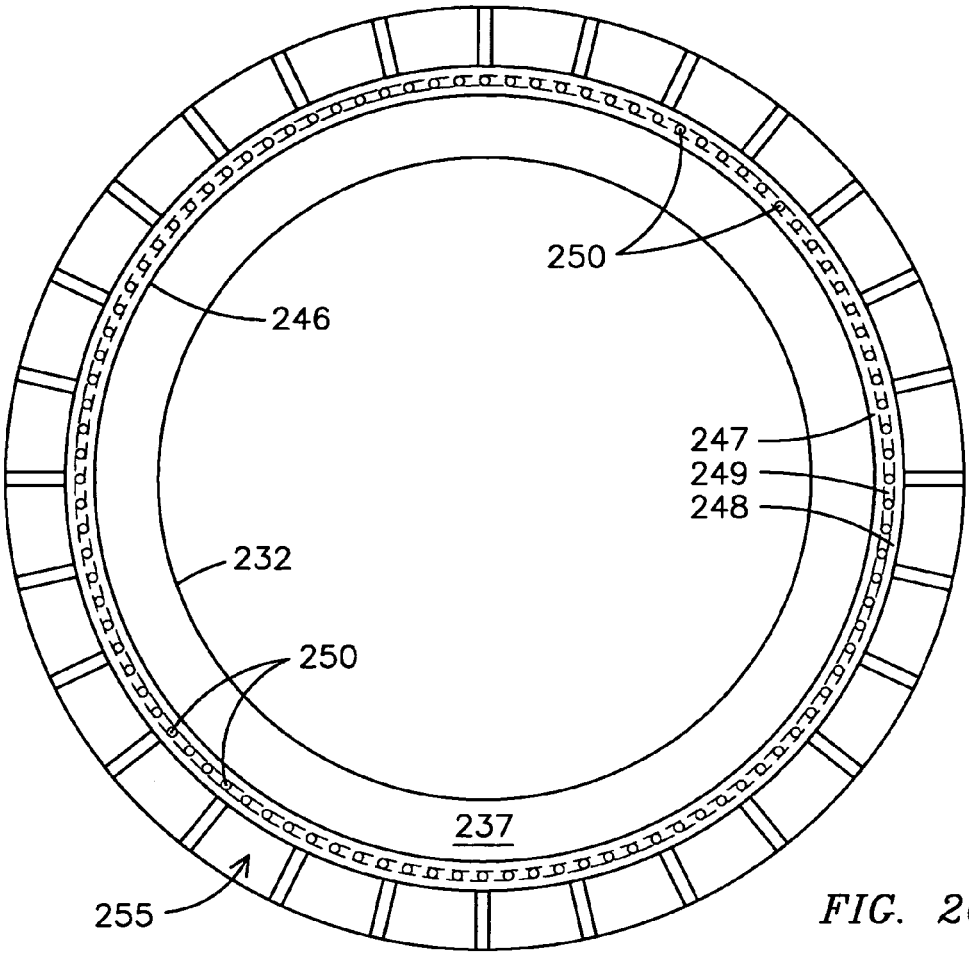
FIG. 2C is a cross-sectional view taken along the line 2C-2C of FIG. 2B, illustrating the flow control ring, inner liner wall and spring clips.

FIG. 2C provides an upstream view from line 2C-2C of FIG. 2B, and depicts the inner wall 232 coated with thermal barrier coating 237, the flow control ring 246, and the spring clip assembly 255. The flow control ring 246 is seen to be viewed as comprising the central region 249 that comprises a plurality of holes 250, the inboard region 247 lying inboard of a central region 249, and the outboard region 248 disposed outboard of the central region 249. These regions are not meant to indicate that the flow control ring is comprised of three separate components annealed together; a typical method of construction is to form a unitary annular body and machine it to comprise desired features, such as the holes 250. In various embodiments, the inboard region 247 and the outboard region 248 comprise respective weld preps (indicated as 253 and 254 in FIG. 2A) that may provide for stronger weld bonds with the adjoining regions of the inner wall 232 and the outer wall 238.

In the embodiment depicted in FIGS. 2A-2C, a cooling air flow supplied by the gas turbine engine compressor (not shown in these figures, see FIG. 3) enters the flow channel 244 at the upstream end 239 of the outer wall 238 passing through the optional protective barrier 229. The cooling air then travels toward the through the holes 250 of the flow control ring 246. This flow of cooling air through the holes 250 is effective to control the cooling air flow, to provide convective cooling along the inner wall 232, and to provide convective cooling of the flow control ring 246. By control, as that term is used herein with regard to the holes 250 is not an active form of control. Rather the control of cooling air flow is a function of a predetermined cross-sectional flow area that does not change in order to effectuate the desired control. The predetermined cross-sectional flow area, and the size, shape, and distribution of holes 250 in a flow control ring 246 are determined as a function of the calculated or modeled flow to achieve a desired level of cooling under varying operating conditions, and may vary from embodiment to embodiment depending on factors that include the presence of a thermal barrier coating on the inner wall 232, and the presence of optional effusion holes through the inner wall 232.

Further, because the holes 250 of flow control ring 246 provide the only defined exits for such cooling air flow, when embodiments such as that depicted in FIGS. 2A-2C are installed in a plurality of combustors in a gas turbine engine, these embodiments are effective to provide a uniformly controlled open cooling of the combustor liner walls. This uniformity contrasts with the less controllable prior art embodiments that may be subject to the aforementioned sources of variability. It is appreciated that this provision of a uniformly controlled open cooling, or alternatively, the property of being effective to control a particular cooling air flow, is based on a passive control, related in part to the size, number and distribution of holes in a flow control ring (or more generally in a flow control regulator), rather than to an 'active' type of control.

The more general term 'flow control regulator' includes flow control rings such as described above, and a flow control regulator also may comprise a plurality of arcuate segments which together comprise an annular shape. However, a flow control regulator need not be annular shaped, nor an annular ring structure, and may be comprised of spacers (which may include weld beads) that are spaced apart to connect inner and outer liner walls proximate a combustor outlet, so that gaps, such as slits, between the spacers are the spaces through which a controlled cooling air flow flows.

Also, the plurality of holes in a flow control ring in embodiments such as that depicted in FIGS. 2A-2C may be effective to cool, to a determined maximum temperature, the inner wall without the use of effusion holes through the inner wall. However, this is not meant to be limiting. For instance, embodiments may comprise a combustor liner comprising an outer wall and an inner wall defining there between a flow channel, and a flow control ring sealingly connected to the inner and the outer walls proximate the combustor outlet, wherein spaced along the inner wall are a number of effusion holes that provide a supplemental flow of cooling air at desired locations along the inner wall. Such effusion holes are effective to supplement the cooling of an inner wall. A number of such optional effusion holes 270 are depicted in FIG. 2B. Generally, these may be placed at appropriate locations along the inner wall 232 to achieve a desired supplemental cooling effect.

Additionally, the flow of cooling air entering the transition (not shown in FIGS. 2A and 2B) may cool the adjacent transition interior walls, an upstream portion 260 of which is depicted in FIG. 2B. This may occur by providing a uniform and spaced flow of cooling air through the holes 250. It is noted that the cooling air exiting the holes 250 are in fluid communication with the combustion zone 208, albeit the holes 250 literally provide air into the transition at the juncture of the combustion zone 208 and the transition (not shown, see FIG. 3). Also, although the inner wall 232 and the outer wall 238 are depicted in FIGS. 2A and 2B as parallel, this is not meant to be limiting. For instance, the spacing between an inner wall and an outer wall may decrease (or may increase) from upstream to downstream ends of a flow channel formed between such walls.

Figure 3:
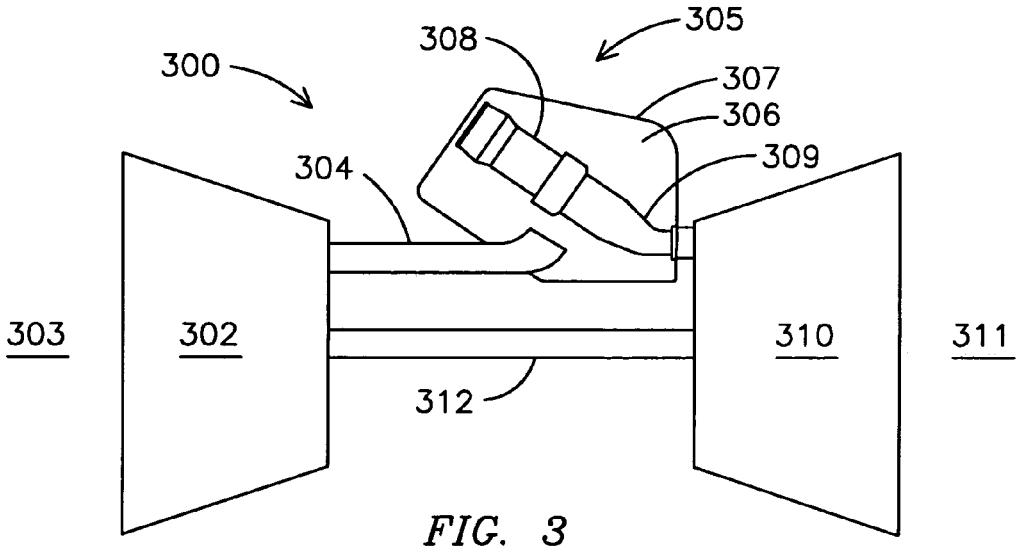
FIG. 3 is a schematic lateral cross-sectional depiction of a gas turbine showing major components, in which embodiments of the present invention may be utilized.

Embodiments of the present invention are used in gas turbine engines such as are represented by FIG. 3, which is a schematic lateral cross-sectional depiction of a prior art gas turbine 300 showing major components. Gas turbine engine 300 comprises a compressor 302 at a leading edge 303, a turbine 310 at a trailing edge 311 connected by shaft 312 to compressor 302, and a mid-frame section 305 disposed therebetween. The mid-frame section 305, defined in part by a casing 307 that encloses a plenum 306, comprises within the plenum 306 a combustor 308 (such as a can-annular combustor) and a transition 309. During operation, in axial flow series, compressor 302 takes in air and provides compressed air to an annular diffuser 304, which passes the compressed air to the plenum 306 through which the compressed air passes to the combustion chamber 308, which mixes the compressed air with fuel (not shown), providing combusted gases via the transition 309 to the turbine 310, whose rotation may be used to generate electricity. It is appreciated that the plenum 306 is an annular chamber that may hold a plurality of circumferentially spaced apart combustors 308, each associated with a downstream transition 309. Likewise the annular diffuser 304, which connects to but is not part of the mid-frame section 305, extends annularly about the shaft 312. Embodiments of the present invention may be incorporated into each combustor (such as 308) of a gas turbine engine to provide a more uniform and controlled open cooling of the combustor liner walls.

Although the above embodiments provide for an outer wall that is distinguished from cylindrical frame 114 of FIG. 1, in some embodiments of the present invention the outer wall may comprise a cylindrical frame. For a gas turbine engine comprising a cylindrical frame as its outer wall, or another type of outer wall, it is appreciated that in a combustor in that engine, comprising an inner wall and such outer wall disposed about a combustion zone, a flow control ring comprising a plurality of holes may be attached to downstream ends of these walls. This would provide an alternative embodiment of the present invention that is effective to regulate and assure more uniformity in cooling fluid flow in this structure.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What is claimed is:

1. A can combustor for a gas turbine engine comprising:

an intake, an outlet, and at least one swirler assembly disposed there between;

a combustion liner comprising an inner wall that partly defines a combustion zone, wherein the combustion zone and the inner wall share a common longitudinal axis and the common longitudinal axis is disposed in the combustion zone, and an outer wall disposed radially outward of the inner wall with respect to the common longitudinal axis, the inner wall and outer wall defining there between a flow channel for passage of a cooling air flow; and a flow control ring directly connected to downstream ends of the inner and outer walls of the combustor proximate the outlet, wherein the flow control ring comprises a plurality of holes in fluid communication with the flow channel and the combustion zone effective to deliver a plurality of discrete flows of cooling fluid into the combustion zone, and wherein during operation the plurality of holes is effective to control the cooling air flow.

2. The combustor of claim 1, additionally comprising a number of effusion holes through the inner wall.

3. The combustor of claim 1, additionally comprising a thermal barrier coating on a portion of an inner surface of the inner wall.

4. The combustor of claim 3, wherein the portion is a major portion of the inner surface.

5. The combustor of claim 1 additionally comprising a protective barrier covering an upstream opening to the flow channel, connecting to at least one of the inner wall and the outer wall, and comprising a plurality of holes for passage of cooling air into the flow channel.

6. The combustor of claim 1, wherein the flow control ring supports by rigid attachment thereto a spring clip assembly extending radially outward.

7. The combustor of claim 6, wherein the outer wall supports by rigid attachment thereto a cylindrical barrier structure formed to limit inward movement of the spring clip assembly and to restrict passage of spring clip fragments.

8. A gas turbine engine comprising the combustor of claim 1.

9. In a can annular gas turbine engine combustor having a combustion liner comprising an inner wall partly defining a combustion zone, wherein the combustion zone and the inner wall share a common longitudinal axis and the common longitudinal axis is disposed in the combustion zone, and an outer walls disposed radially outward of the inner wall with respect to the common longitudinal axis, the inner wall and outer wall defining a flow channel therebetween, the improvement comprising a flow control regulator connected directly to downstream ends of inner and outer walls of the combustor, wherein the flow control regulator further comprises a plurality of holes in fluid communication with the flow channel and the combustion zone that are effective to deliver a plurality of discrete flows of cooling fluid into the combustion zone.

10. A combustor liner assembly for a gas turbine engine can combustor comprising an outer wall disposed radially outward of an inner wall, wherein the inner wall partly defines a combustion zone, wherein the combustion zone and the inner wall share a common longitudinal axis and the common longitudinal axis is disposed in the combustion zone, each said wall comprising an inlet end and an outlet end, a channel between the inner wall and the outer wall, a flow control regulator welded to downstream ends of the inner and outer walls of the combustor proximate the outlet ends and comprising a plurality of holes in fluid communication with the flow channel that are effective to deliver a plurality of discrete flows of cooling fluid into the combustion zone.

11. A gas turbine engine combustor comprising the combustor liner assembly of claim 10.

12. A gas turbine engine comprising the combustor of claim 11.

13. A can annular gas turbine combustion engine comprising a plurality of combustor cans disposed therein, each said combustor can comprising:

an intake, an outlet, and at least one swirler assembly disposed there between;

a combustion liner comprising an inner wall that partly defines a combustion zone, wherein the combustion zone and the inner wall share a common longitudinal axis and the common longitudinal axis is disposed in the combustion zone and an outer wall disposed radially outward of the inner wall with respect to the common longitudinal axis, the inner wall and outer wall defining there between a flow channel for passage of a cooling air flow; and a flow control ring connected directly to downstream ends of the inner and outer walls and comprising a plurality of holes in fluid communication with the flow channel and the combustion zone effective to deliver a plurality of discrete flows of cooling fluid into the combustion zone, wherein collectively said plurality of holes are effective to provide a uniformly controlled cooling among each respective combustor liner wall.

* * * * *